US010456937B2

(12) United States Patent
Veldhuis et al.

(10) Patent No.: US 10,456,937 B2
(45) Date of Patent: Oct. 29, 2019

(54) GUARD ELEMENT FOR USE IN A HAIR CUTTING UNIT

(71) Applicant: KONINKLIJKE PHILIPS N.V., Eindhoven (NL)

(72) Inventors: Mark Klaas Albert Veldhuis, Eindhoven (NL); Johannes Silvius, Eindhoven (NL); Redmer Van Tijum, Eindhoven (NL); Gerrit Klaseboer, Eindhoven (NL); Steven Johan Grobbink, Eindhoven (NL); Ingmar Grasmeijer, Eindhoven (NL); Remi Alex Guillebot, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 15/531,482

(22) PCT Filed: Dec. 4, 2015

(86) PCT No.: PCT/EP2015/078678
§ 371 (c)(1),
(2) Date: May 30, 2017

(87) PCT Pub. No.: WO2016/091750
PCT Pub. Date: Jun. 16, 2016

(65) Prior Publication Data

US 2017/0266824 A1 Sep. 21, 2017

(30) Foreign Application Priority Data

Dec. 9, 2014 (EP) ..... 14196888

(51) Int. Cl.
*B26B 19/14* (2006.01)
*B26B 19/38* (2006.01)
(Continued)

(52) U.S. Cl.
CPC ..... *B26B 19/3813* (2013.01); *B26B 19/14* (2013.01); *B26B 19/143* (2013.01);
(Continued)

(58) Field of Classification Search
CPC ... B26B 19/143; B26B 19/3813; B26B 19/20; B26B 19/14; B26B 19/3806; B26B 19/00
(Continued)

(56) References Cited

U.S. PATENT DOCUMENTS 2,616,168 A * 11/1952 Dankers ..... B26B 19/141 30/225
3,116,551 A * 1/1964 Anton ..... B26B 19/141 30/346.51
(Continued)

FOREIGN PATENT DOCUMENTS

CN 202668590 U 1/2013
FR 899359 A 5/1945
(Continued)

*Primary Examiner* — Hwei-Siu C Payer

(57) ABSTRACT

A guard element (4) for use in a hair cutting unit as a guard of a movable hair cutting element of the hair cutting unit has a disc-shaped base (10) and an annular wall (20) comprising a main part (21) extending from the periphery of the base (10), and a flange-shaped part (22) comprising an outwardly bent section (24). The annular wall (20) is reinforced on the basis of at least one of a design where a smallest inner periphery of the flange-shaped part (22) has a diameter which is smaller than a diameter of a largest inner periphery of a straight section (23) of the main part (21) connected to the periphery of the base (10), and a design where a free end section (25) of the flange-shaped part (22) is at least partially bent. In an embodiment, at least a portion of the main wall part (21) of the guard element (4) tapers inwardly in a direction along a central axis (11) of the disc-shaped base (10), from the disc-shaped base (10) to the flange-shaped wall part (22), such that the flange-shaped wall part (22) is
(Continued)

enlarged with respect to a flange-shaped wall part (22) of a guard element (5) not having the tapered shape of the main wall part (21), resulting in increased stiffness and an increased resonant frequency of the guard element (4).

13 Claims, 2 Drawing Sheets

(51) Int. Cl.
*B26B 19/20* (2006.01)
*B26B 19/00* (2006.01)

(52) U.S. Cl.
CPC ..... *B26B 19/20* (2013.01); *B26B 19/3806* (2013.01); *B26B 19/3826* (2013.01); *B26B 19/00* (2013.01)

(58) Field of Classification Search
USPC ..... 30/43.6
See application file for complete search history.

(56) References Cited

U.S. PATENT DOCUMENTS 3,191,297 A * 6/1965 Driessen ..... B26B 19/14 30/346.51
3,844,033 A 10/1974 Yonkers
3,913,225 A * 10/1975 Tietjens ..... B26B 19/145 30/43.6
4,038,748 A 8/1977 Tyler
4,168,570 A 9/1979 Bakker et al.
4,393,586 A * 7/1983 Hamashima ..... B26B 19/143 30/346.51
6,769,179 B2 * 8/2004 Satoh ..... B26B 19/04 30/346.51
7,065,878 B2 6/2006 Uchiyama
9,873,204 B2 * 1/2018 Zuider ..... B26B 19/141
2007/0277379 A1 12/2007 Okabe
2010/0073501 A1 3/2010 Cheng
2012/0246940 A1 10/2012 Veenstra et al.
2014/0157957 A1 6/2014 Mimura
2017/0266824 A1 * 9/2017 Veldhuis ..... B26B 19/3813
2017/0291319 A1 * 10/2017 Hendriks ..... B26B 19/388

FOREIGN PATENT DOCUMENTS

JP 52081384 6/1977
JP 54104970 A 8/1979
WO 2005000539 A1 1/2005
WO 2013021514 A1 2/2013
WO 2014073501 A1 5/2014

* cited by examiner

GUARD ELEMENT FOR USE IN A HAIR CUTTING UNIT

This application is the U.S. National Stage application under 35 U.S.C. § 371 of International Patent Application No. PCT/EP2015/078678, filed on Dec. 4, 2015, which claims the benefit of European Patent Application No. 14196888.3 filed on Dec. 9, 2014. These applications are hereby incorporated by reference herein.

FIELD OF THE INVENTION

The invention relates to a guard element for use in a hair cutting unit as a guard for a movable hair cutting element of the hair cutting unit, which guard element is generally cup-shaped and comprises a disc-shaped base and an annular wall, wherein the disc-shaped base comprises a central axis and a peripheral section which is curved when seen in a central cross-section of the guard element comprising the central axis, and wherein the annular wall comprises a main part and a flange-shaped part, wherein the main part of the annular wall has a substantially upright orientation with respect to the disc-shaped base and comprises a straight section, which is uncurved when seen in the central cross-section and is connected to the peripheral section of the disc-shaped base, and wherein the flange-shaped part of the annular wall comprises an outwardly bent section, which is bent outwardly relative to the central axis when seen in the central cross-section, and a free end section, wherein the outwardly bent section of the flange-shaped part of the annular wall interconnects the main part of the annular wall and the free end section of the flange-shaped part of the annular wall.

The invention further relates to a hair cutting unit comprising a guard element according to the invention, and to a hair cutting appliance comprising a hair cutting unit according to the invention.

BACKGROUND OF THE INVENTION

U.S. Pat. No. 4,168,570 discloses a shaving appliance, which comprises a housing, a stationary cutting element, and a rotatable cutting element, the stationary cutting element taking the form of a cap in which hair-entry apertures are formed, which cap is positioned inside the housing by means of a rim and is depressable in an inward direction relative to the housing against spring force. During a shaving action, the cap is moved across a portion of skin, catching hairs to be cut off in the process, while preventing direct contact between the skin and the rotatable cutting element.

In particular, the cap is disposed in an opening of a plate-like cap holder which forms part of the housing. The rim of the cap is provided with a flange, which engages a receding rim of the cap holder, wherein the cap is positioned such that it projects from the cap holder as far as possible. The cap is biased in an outward direction with respect to the cap holder by means of a resilient element. Also, the rotatable cutting element exerts an outwardly directed resilient force on the cap, because a drive spindle for the rotatable cutting element is axially supported by a resilient element.

The shaving appliance known from U.S. Pat. No. 4,168,570 comprises three caps. On the basis of the resilient bias of the caps as mentioned, it is possible to maintain contact between all three caps and the portion of skin to be subjected to a shaving action, for various shapes of the portion of skin.

A problem associated with the known shaving appliance is that the rotating cutting element initiates vibrations of the cap. The amplitude of the vibrations of the cap is dependent on the resonant frequency of the cap. When the frequency of the vibrations is close to the resonant frequency of the cap, the cap will start to resonate and the amplitude of the cap vibrations will strongly increase, resulting in a high noise production, or even in permanent damage of the cap and/or other elements of the shaving appliance. In general, the risk of resonating of the cap is high in the case of a relatively thin cap, i.e. a cap having a relatively small material thickness, as the resonant frequency of such a cap consequently appears to be within the range of operating frequencies of the rotatable cutting element. In general, caps are often made as thin as possible in order to ensure a close shave. Therefore, the high noise production is a widespread problem in the field of shaving appliances and similar hair cutting appliances which are equipped with at least one cap as described in the foregoing.

SUMMARY OF THE INVENTION

It is an object of the invention to solve the problem of high noise production in a hair cutting appliance such as the shaving appliance known from U.S. Pat. No. 4,168,570. The object is achieved by amending the design of the guard element which is used in a hair cutting unit of the appliance as a guard of a movable hair cutting element. In particular, the invention provides a guard element for use in a hair cutting unit as a guard for a movable hair cutting element of the hair cutting unit, which guard element is generally cup-shaped and comprises a disc-shaped base and an annular wall, wherein the disc-shaped base comprises a central axis and a peripheral section which is curved when seen in a central cross-section of the guard element comprising the central axis, and wherein the annular wall comprises a main part and a flange-shaped part, wherein the main part of the annular wall has a substantially upright orientation with respect to the disc-shaped base and comprises a straight section, which is uncurved when seen in the central cross-section and which is connected to the peripheral section of the disc-shaped base, and wherein the flange-shaped part of the annular wall comprises an outwardly bent section, which is bent outwardly relative to the central axis when seen in the central cross-section, and a free end section, wherein the outwardly bent section of the flange-shaped part of the annular wall interconnects the main part of the annular wall and the free end section of the flange-shaped part of the annular wall, and wherein the annular wall is reinforced on the basis of at least one of a design where a smallest inner periphery of the flange-shaped part of the annular wall has a diameter which is smaller than a diameter of a largest inner periphery of the straight section of the main part of the annular wall, and a design where the free end section of the flange-shaped part of the annular wall is at least partially bent.

In the following, for the sake of clarity, the guard element according to the invention is denoted as cap in conformity with the nomenclature of U.S. Pat. No. 4,168,570. According to an insight underlying the invention, it is not necessary to take complex measures aimed at altering the suspension of the cap in the cap holder, for example, in order to avoid resonating of the cap. Instead, amendments to the design of the cap are proposed, which do not necessarily need to involve an increase of material thickness of the cap. The amendments are aimed at increasing the stiffness of the cap. To this end, the smallest inner periphery of the flange-shaped part of the annular wall of the cap may be provided with a diameter which is smaller than the diameter of the largest inner periphery of the straight section of the main part of the annular wall, instead of the same diameter or a larger diameter as is conventional, so that it is possible to realize an increased width of the flange-shaped part of the annular wall without needing to increase an outer diameter of the flange-shaped part of the annular wall. Alternatively or additionally, the free end section of the flange-shaped part of the annular wall of the cap may be at least partially bent such as to realize a curved shape which leads to increased stiffness of the flange-shaped part of the annular wall as such, and thereby also to increased stiffness of the cap.

An increase of the stiffness of the cap automatically brings about an increase of the resonant frequency of the cap, as desired in order to obtain a situation in which the resonant frequency of the cap is surely higher than the frequency associated with movement of the hair cutting element. In this respect, it is noted that the general definition of the resonant frequency is as follows:

$$f_0 = \frac{1}{2\pi}\sqrt{\frac{k}{m}}$$

wherein $f_0$ represents the resonant frequency, k represents the stiffness, and m represents the mass.

Preferably, an amended design of the cap is chosen in which the cap is still suitable to be put in position in a relevant appliance without a need for an amendment of the design of the appliance in the area for receiving the cap. In other words, it is desirable to have a new design of the cap which is backward compatible. The invention involves options for providing such a backward compatible design.

Within the framework of the invention, increased stiffness of a cap for solving the problem of resonation of the cap and the associated high noise production can be achieved by one of the following practical options: 1) at least a portion of the main part of the annular wall tapers inwardly in a direction along the central axis from the disc-shaped base to the flange-shaped part of the annular wall; 2) the free end section of the flange-shaped part of the annular wall is bent upwards towards the disc-shaped base, such that the flange-shaped part is U-shaped when seen in the central cross-section; 3) the main part of the annular wall is partially bent when seen in the central cross-section, wherein the main part of the annular wall may particularly be provided with an inward annular bulge at a transition to the outwardly bent section of the flange-shaped part of the annular wall; and 4) the free end section of the flange-shaped part of the annular wall is bent inwardly towards the central axis. It is possible to have a combination of these options. For example, the tapered shape of the main part of the annular wall may be combined with a curved shape of the free end section of the flange-shaped part of the annular wall.

Alternative measures aimed at increasing the stiffness of a cap include increasing the outer diameter of the flange-shaped part of the annular wall and increasing the material thickness of the cap, although the latter is not favorable in the context of shaving as explained in the foregoing. For example, the outer diameter of the flange-shaped part of the annular wall may be 24 mm in a design which is adapted for having increased stiffness of the cap, whereas the outer diameter of the same part in an earlier design may be 22 mm. Furthermore, in the adapted design, the material thickness of the cap may be 0.3 mm, while the material thickness of the cap in the earlier design may be 0.2 mm. It is noted that the option of increasing material thickness of the cap yields a design of the cap which is backward compatible, and that the same is applicable to the option according to the invention of providing the main part of the annular wall with an inward annular bulge at the transition to the outwardly bent section of the flange-shaped part of the annular wall, and also to the option according to the invention wherein at least a portion of the main part of the annular wall tapers inwardly in the direction along the central axis, from the disc-shaped base to the flange-shaped part of the annular wall.

A hair cutting unit according to the invention comprises a guard element according to the invention and a movable hair cutting element rotatably arranged in an inner space of the guard element which is surrounded by the main part of the annular wall.

A hair cutting appliance according to the invention comprises a main body for a user of the hair cutting appliance to take hold of and a head including at least one hair cutting unit according to the invention.

The above-described and other aspects of the invention will be apparent from and elucidated with reference to the following detailed description of various embodiments of a guard element or cap according to the invention for use in a shaving appliance. The fact that the invention will be explained in the context of a shaving appliance should not be understood such as to imply that the invention cannot be used in other hair cutting appliances comprising one or more guard elements or caps as a guard of a movable hair cutting element of the appliance.

BRIEF DESCRIPTION OF THE DRAWINGS

The invention will now be explained in greater detail with reference to the figures, in which equal or similar parts are indicated by the same reference signs, and in which.

DETAILED DESCRIPTION OF EMBODIMENTS

Figure 1A:
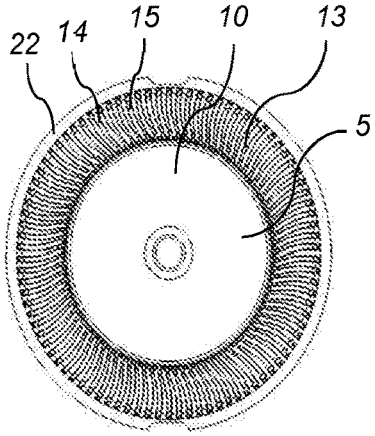
Fig. 1a PRIOR ART
FIGS. 1*a* and 1*b* show a top view and a sectional view of a cap having a conventional design.
Figure 1B:
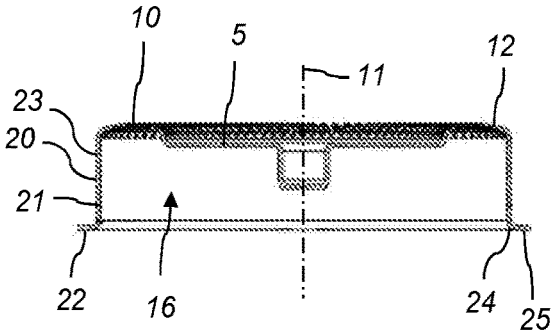
Fig. 1b PRIOR ART

FIGS. 1*a* and 1*b* show a guard element or cap having a conventional design, which is suitable to be used in a shaving appliance (not shown) as a guard of a movable hair cutting element of the appliance, which will hereinafter be referred to as known cap 5, or as known guard element 5. A shaving appliance comprising such a cap is generally known, and therefore, the particulars of such appliance will not be further explained. For the sake of completeness, it is noted that an example of such appliance can be found in U.S. Pat. No. 4,168,570, as mentioned earlier. Generally speaking, a shaving appliance comprises a main body for a user of the shaving appliance to take hold of and a head including at least one shaving unit, wherein a shaving unit is defined as a unit comprising a combination of a cap and a movable hair cutting element. The cap is normally made of metal.

The known cap 5 is generally cup-shaped, comprising a disc-shaped base 10 and an annular wall 20. The disc-shaped base 10 has a circular periphery, comprising a central axis 11 and a peripheral section 12 which is curved when seen in a central cross-section of the cap 5 comprising the central axis 11, as illustrated in FIG. 1*b*. The annular wall 20 comprises a main part 21 extending from the outer periphery of the disc-shaped base 10, wherein the annular wall 20 is bent outwardly at a free end thereof, so that the annular wall 20 has a flange-shaped part 22 besides the main part 21. An important function of the flange-shaped part 22 is to constitute a rim for locking the cap 5 in a radially outward direction in a shaving appliance having a hole in a plate or the like for accommodating the cap 5. In the following, for the sake of clarity, words like "top", "underneath" and "downwards" are used in the explanation of the particulars of the cap 5, wherein these words should be understood to be related to the orientation of the cap 5 as shown in FIG. 1*b*, i.e. a functional orientation in which the disc-shaped base 10 is at a top side and the annular wall 20 extends downwards from the disc-shaped base 10.

As can be seen in FIG. 1*a*, the disc-shaped base 10 includes an annular shaving track 13 with a plurality of radially extending hair-entry apertures 14 between which lamellae 15 are present. During a shaving operation in which the cap 5 is applied, the hair-entry apertures 14 allow hairs to be cut off to extend through the cap 5 at the position of the annular shaving track 13 and encounter cutters of a rotating cutting element (not shown) which is arranged in an inner space 16 of the cap 5 as present underneath the disc-shaped base 10 and surrounded by the main part 21 of the annular wall 20.

The main part 21 of the annular wall 20 has a substantially upright orientation with respect to the disc-shaped base 10 and comprises a straight section 23, which is uncurved (i.e. free from curves) when seen in the central cross-section, as illustrated in FIG. 1*b*. The straight section 23 is connected to the peripheral section 12 of the disc-shaped base 10. Furthermore, the flange-shaped part 22 of the annular wall 20 comprises an outwardly bent section 24 and a free end section 25. The outwardly bent section 24 is bent outwardly relative to the central axis 11 when seen in the central cross-section, as illustrated in FIG. 1*b*, and interconnects the main part 21 of the annular wall 20 and the free end section 25 of the flange-shaped part 22.

According to the invention, a guard element or cap is provided which has another design than the known cap 5, in particular a design involving an increased stiffness of the cap, more in particular a design involving increased stiffness of the annular wall 20, most in particular a design involving increased stiffness of the flange-shaped part 22 of the annular wall 20. In the following, particulars of four embodiments of such a cap according to the invention will be elucidated. In particular, it will be pointed out how the design of the cap according to the invention deviates from the conventional design. The general features of the known cap 5, especially the cup shape with the disc-shaped base 10 including the annular shaving track 13 and the annular wall 20 comprising a main part 21 and a flange-shaped part 22, the main part 21 having a straight section 23 and the flange-shaped part 22 having an outwardly bent section 24 and a free end section 25, are also applicable to the embodiments of the cap according to the invention. Therefore, like elements to those of FIGS. 1*a* and 1*b* will be designated with like numerals, even though FIGS. 1*a* and 1*b* relate to a conventional situation whereas the other figures relate to the invention. On the basis of the increased stiffness of the cap, the resonant frequency of the cap is increased, such that it is ensured that the resonant frequency of the cap is high enough to avoid a situation of resonance when the shaving appliance in which the cap is to be applied is in operation and a cutting element of the shaving appliance rotates in the inner space 16 of the cap.

Figure 2A:
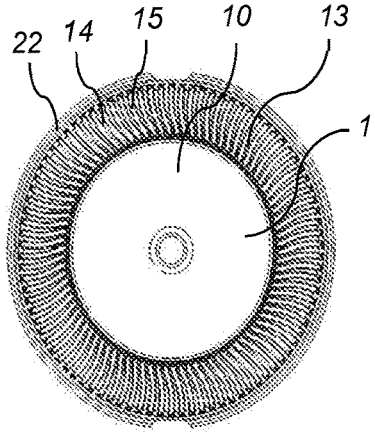
FIGS. 2*a* and 2*b* show a top view and a sectional view of a cap according to a first embodiment of the invention.
Figure 2B:
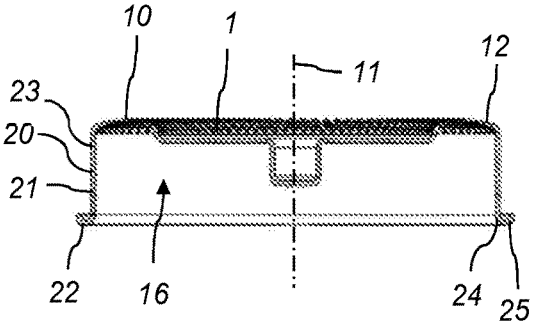

FIGS. 2*a* and 2*b* show a cap according to a first embodiment of the invention, which will hereinafter be referred to as first cap 1, or as a guard element 1. Contrary to the known cap 5, in which the flange-shaped part 22 has the general appearance of a planar ring, the first cap 1 comprises a bent flange-shaped part 22, particularly a flange-shaped part 22 having a U-shaped cross-section as seen in the central cross-section of the first cap 1 shown in FIG. 2*b*. In particular, said U-shaped cross-section is achieved by the fact that the free end section 25 of the flange-shaped part 22 is bent upwards towards the disc-shaped base 10. On the basis of the curved appearance of the flange-shaped part 22, the stiffness of the first cap 1 is higher than the stiffness of the known cap 5.

Figure 3A:
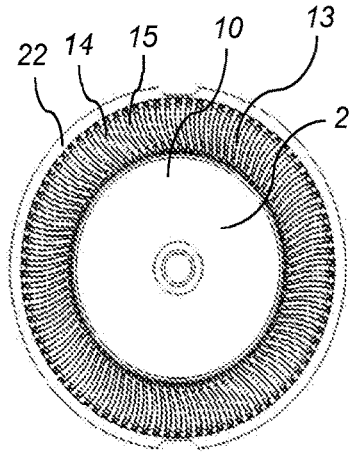
FIGS. 3*a* and 3*b* show a top view and a sectional view of a cap according to a second embodiment of the invention.
Figure 3B:
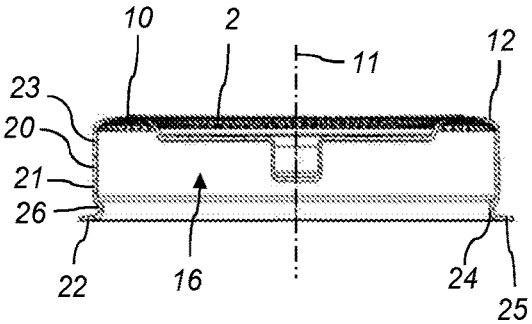

FIGS. 3*a* and 3*b* show a cap according to a second embodiment of the invention, which will hereinafter be referred to as second cap 2, or as a guard element 2. Contrary to the known cap 5, in which the main part 21 of the annular wall 20 has a generally continuous appearance without any irregularities, the annular wall 20 of the second cap 2 comprises a main part 21 which is partially bent when seen in the central cross-section of the second cap 2 shown in FIG. 3*b*, particularly a main part 21 which is provided with an inward annular bulge 26, as illustrated in FIG. 3*b*. In particular, the inward annular bulge 26 is present at the transition of the main part 21 of the annular wall 20 to the outwardly bent section 24 of the flange-shaped part 22 of the annular wall 20, so that the presence of the inward annular bulge 26 results in an increased width of the flange-shaped part 22, obtained on the basis of a decreased inner diameter of a smallest inner periphery of the flange-shaped part 22 as compared to the smallest inner periphery of the flange-shaped part 22 of the known cap 5. In particular, in the known cap 5 the diameter of the smallest inner periphery of the flange-shaped part 22 is equal to the diameter of a largest inner periphery of the straight section 23 of the main part 21 of the annular wall 20, while in the second cap 2 the diameter of the smallest inner periphery of the flange-shaped part 22 is smaller than the diameter of a largest inner periphery of the straight section 23 of the main part 21 of the annular wall 20. Said decreased inner diameter of the flange-shaped part 22 of the second cap 2 involves an increased difference between the outer diameter and the inner diameter of the flange-shaped part 22. For example, the inner diameter of the flange-shaped part 22 may be decreased by 0.6 mm on the basis of the presence of the inward annular bulge 26. All in all, on the basis of the curved appearance of the main part 21 at the transition to the flange-shaped part 22, the stiffness of the second cap 2 is higher than the stiffness of the known cap 5.

Figure 4A:
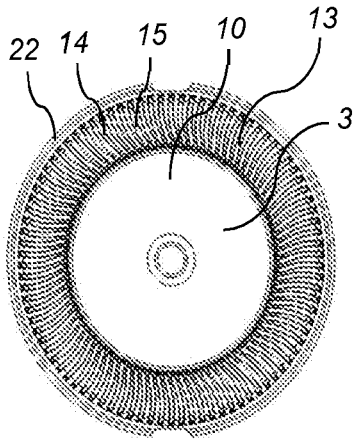
FIGS. 4*a* and 4*b* show a top view and a sectional view of a cap according to a third embodiment of the invention.
Figure 4B:
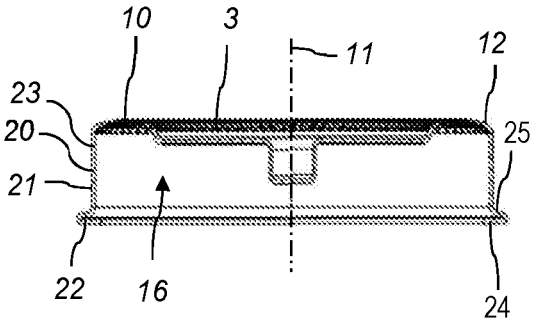

FIGS. 4*a* and 4*b* show a cap according to a third embodiment of the invention, which will hereinafter be referred to as third cap 3, or as a guard element 3. Contrary to the known cap 5, in which the flange-shaped part 22 of the annular wall 20 has the general appearance of a planar ring, the third cap 3 comprises a partially bent free end section 25 of the flange-shaped part 22, particularly a free end section 25 which is bent inwardly towards the central axis 11 as can be seen in FIG. 4*b*, wherein an increased difference between the outer diameter and the inner diameter of the flange-shaped part 22 is obtained. All in all, on the basis of the bent appearance of the free end section 25 of the flange-shaped part 22, the stiffness of the third cap 3 is higher than the stiffness of the known cap 5.

Figure 5A:
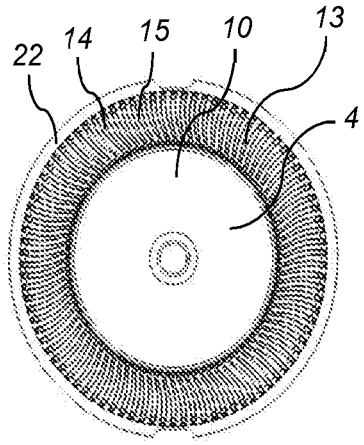
FIGS. 5*a* and 5*b* show a top view and a sectional view of a cap according to a fourth embodiment of the invention.
Figure 5B:
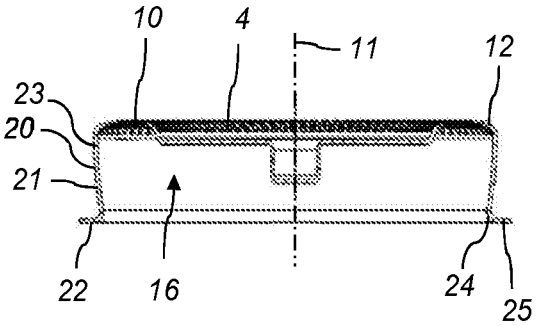

FIGS. 5*a* and 5*b* show a cap according to a fourth embodiment of the invention, which will hereinafter be referred to as fourth cap 4, or as a guard element 4. Contrary to the known cap 5, in which the main part 21 of the annular wall 20 has a constant diameter along its height, the annular wall 20 of the fourth cap 4 comprises a main part 21 which tapers inwardly in a downward direction as can be seen in FIG. 5*b*, i.e. tapers inwardly in a direction along the central axis 11 from the disc-shaped base 10 to the flange-shaped part 22. In particular, the tapered shape of the main part 21 of the annular wall 20 results in an increased width of the flange-shaped part 22, obtained on the basis of a decreased inner diameter of the smallest inner periphery of the flange-shaped part 22 as compared to the smallest inner periphery of the flange-shaped part 22 of the known cap 5. In particular, in the fourth cap 4 the diameter of the smallest inner periphery of the flange-shaped part 22 is smaller than the diameter of a largest inner periphery of the straight section 23 of the main part 21 of the annular wall 20, wherein said largest inner periphery of the straight section 23 is present at the location where the straight section 23 connects to the peripheral section 12 of the disc-shaped base 10. Said decreased inner diameter of the flange-shaped part 22 of the fourth cap 4 involves an increased difference between the outer diameter and the inner diameter of the flange-shaped part 22. All in all, on the basis of the tapered appearance of the main part 21 of the annular wall 20, the stiffness of the fourth cap 4 is higher than the stiffness of the known cap 5.

Figure 6:
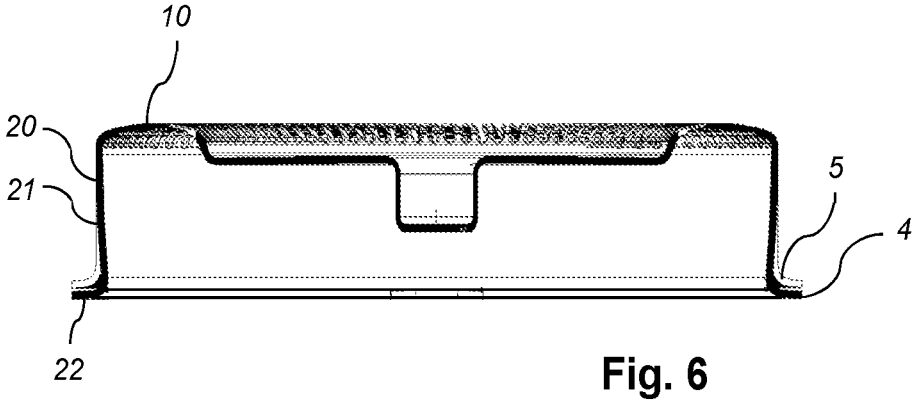
FIG. 6 illustrates the difference between the cap according to the fourth embodiment of the invention and a cap having a conventional design.

FIG. 6 illustrates the difference between the fourth cap 4 and the known cap 5 by showing sectional views of both caps 4, 5, with the disc-shaped bases 10 of both caps 4, 5 being in an overlapping position. The basic outline of the sectional view of the fourth cap 4 is indicated by means of a black line, whereas the basic outline of the sectional view of the known cap 5 is indicated by means of a white line cased in black. In this way, it can clearly be seen that the main part 21 of the annular wall 20 of the fourth cap 4 has a tapered shape with respect to the main part 21 of the annular wall 20 of the known cap 5, and that the flange-shaped part 22 of the fourth cap 4 extends more inwardly towards the central axis 11 than the flange-shaped part 22 of the known cap 5 while having a similar outer diameter as the flange-shaped part 22 of the known cap 5, as a result of which the flange-shaped part 22 of the fourth cap 4 has a larger width than the flange-shaped part 22 of the known cap 5.

It will be clear to a person skilled in the art that the scope of the invention is not limited to the examples discussed in the foregoing, but that several amendments and modifications thereof are possible without deviating from the scope of the invention as defined in the attached claims. While the invention has been illustrated and described in detail in the figures and the description, such illustration and description are to be considered illustrative or exemplary only, and not restrictive. The invention is not limited to the disclosed embodiments.

Variations to the disclosed embodiments can be understood and effected by a person skilled in the art in practicing the claimed invention, from a study of the figures, the description and the attached claims. In the claims, the word "comprising" does not exclude other steps or elements, and the indefinite article "a" or "an" does not exclude a plurality. The mere fact that certain measures are recited in mutually different dependent claims does not indicate that a combination of these measures cannot be used to advantage. Any reference signs in the claims should not be construed as limiting the scope of the invention.

Summarizing, when the invention is applied, the flange-shaped part 22 of the annular wall 20 of a guard element 1, 2, 3, 4 is provided with a certain bent shape and/or is enlarged with respect to the flange-shaped part 22 of the annular wall 20 of a known guard element 5 not having an adapted design of the annular wall 20. In this way, the annular wall 20 is reinforced, on the basis of which an increased stiffness and an increased resonant frequency of the guard element 1, 2, 3, 4 according to the invention are obtained with respect to the known guard element 5, which is advantageous because noise associated with the operation of a hair cutting appliance including the guard element can thereby be reduced.

The invention claimed is:

1. A guard element for use in a hair cutting unit as a guard for a movable hair cutting element of the hair cutting unit, which guard element is generally cup-shaped and comprises a disc-shaped base and an annular wall, wherein the disc-shaped base comprises a central axis and a peripheral section which is curved when seen in a central cross-section of the guard element comprising the central axis; and the annular wall comprises a main part and a flange-shaped part; and wherein the main part of the annular wall has a substantially upright orientation with respect to the disc-shaped base and comprises a straight section, which is uncurved when seen in the central cross-section and which is connected to the peripheral section of the disc-shaped base, and the main part of the annular wall is partially bent when seen in the central cross-section; and the flange-shaped part of the annular wall comprises an outwardly bent section, which is bent outwardly relative to the central axis when seen in the central cross-section, and a free end section;

wherein the outwardly bent section of the flange-shaped part of the annular wall interconnects the main part of the annular wall and the free end section of the flange-shaped part of the annular wall; and wherein the annular wall is reinforced based on a design where a smallest inner periphery of the flange-shaped part of the annular wall has a diameter which is smaller than a diameter of a largest inner periphery of the straight section of the main part of the annular wall.

2. The guard element according to claim 1, wherein the main part of the annular wall has an inward annular bulge at a transition to the outwardly bent section of the flange-shaped part of the annular wall.

3. A hair cutting unit, comprising a guard element according to claim 1 and a movable hair cutting element rotatably arranged in an inner space of the guard element which is surrounded by the main part of the annular wall.

4. A hair cutting appliance, comprising a main body for a user of the hair cutting appliance to take hold of and a head including at least one hair cutting unit according to claim 3.

5. A guard element for use in a hair cutting unit as a guard for a movable hair cutting element of the hair cutting unit, which guard element is generally cup-shaped and comprises a disc-shaped base and an annular wall, wherein the disc-shaped base comprises a central axis and a peripheral section which is curved when seen in a central cross-section of the guard element comprising the central axis; and the annular wall comprises a main part and a flange-shaped part; and wherein the main part of the annular wall has a substantially upright orientation with respect to the disc-shaped base and comprises a straight section, which is uncurved when seen in the central cross-section and which is connected to the peripheral section of the disc-shaped base; and the flange-shaped part of the annular wall comprises an outwardly bent section, which is bent outwardly relative to the central axis when seen in the central cross-section, and a free end section;

wherein the outwardly bent section of the flange-shaped part of the annular wall interconnects the main part of the annular wall and the free end section of the flange-shaped part of the annular wall; and wherein the annular wall is reinforced based on at least one of a design where a smallest inner periphery of the flange-shaped part of the annular wall has a diameter which is smaller than a diameter of a largest inner periphery of the straight section of the main part of the annular wall, and a design where the free end section of the flange-shaped part of the annular wall is bent inwardly towards the central axis.

6. The guard element according to claim 5, wherein at least a portion of the main part of the annular wall tapers inwardly in a direction along the central axis from the disc-shaped base to the flange-shaped part of the annular wall.

7. The guard element according to claim 5, wherein the main part of the annular wall is partially bent when seen in the central cross-section.

8. The guard element according to claim 7, wherein the main part of the annular wall has an inward annular bulge at a transition to the outwardly bent section of the flange-shaped part of the annular wall.

9. A hair cutting unit, comprising a guard element according to claim 5; and a movable hair cutting element rotatably arranged in an inner space of the guard element, which is surrounded by the main part of the annular wall.

10. A hair cutting appliance, comprising: a main body for a user of the hair cutting appliance to take hold of; and a head including at least one hair cutting unit according to claim 9.

11. A guard element for use in a hair cutting unit as a guard for a movable hair cutting element of the hair cutting unit, which guard element is generally cup-shaped and comprises a disc-shaped base and an annular wall, wherein the disc-shaped base comprises a central axis and a peripheral section which is curved when seen in a central cross-section of the guard element comprising the central axis; and the annular wall comprises a main part and a flange-shaped part; and wherein the main part of the annular wall has a substantially upright orientation with respect to the disc-shaped base and comprises a straight section, which is uncurved when seen in the central cross-section and which is connected to the peripheral section of the disc-shaped base, and at least a portion of the main part of the annular wall tapers inwardly in a direction along the central axis from the disc-shaped base to the flange-shaped part of the annular wall; and the flange-shaped part of the annular wall comprises an outwardly bent section, which is bent outwardly relative to the central axis when seen in the central cross-section, and a free end section;

wherein the outwardly bent section of the flange-shaped part of the annular wall interconnects the main part of the annular wall and the free end section of the flange-shaped part of the annular wall; and wherein the annular wall is reinforced on based on a design where a smallest inner periphery of the flange-shaped part of the annular wall has a diameter which is smaller than a diameter of a largest inner periphery of the straight section of the main part of the annular wall.

12. A hair cutting unit, comprising a guard element according to claim 11, and a movable hair cutting element rotatably arranged in an inner space of the guard element which is surrounded by the main part of the annular wall.

13. A hair cutting appliance, comprising a main body for a user of the hair cutting appliance to take hold of and a head including at least one hair cutting unit according to claim 12.

* * * * *